US008579291B2

(12) United States Patent
Williams

(10) Patent No.: US 8,579,291 B2
(45) Date of Patent: Nov. 12, 2013

(54) GRADUATION GAME

(76) Inventor: Keith R. Williams, Montreal (CA)

( * ) Notice: Subject to any disclaimer, the term of this patent is extended or adjusted under 35 U.S.C. 154(b) by 0 days.

(21) Appl. No.: 11/522,931

(22) Filed: Sep. 19, 2006

(65) Prior Publication Data

US 2008/0067742 A1 Mar. 20, 2008

(51) Int. Cl.
*A63F 3/00* (2006.01)

(52) U.S. Cl.
USPC ..... 273/249; 273/242

(58) Field of Classification Search
USPC ..... 273/249, 242, 146, 287
See application file for complete search history.

(56) References Cited

U.S. PATENT DOCUMENTS

| | | | | | |
|---|---|---|---|---|---|
| 1,572,254 | A | * | 2/1926 | Tornes | 273/249 |
| 3,594,003 | A | * | 7/1971 | Elder | 273/272 |
| 3,672,680 | A | * | 6/1972 | Grey | 273/260 |
| 4,065,131 | A | | 12/1977 | Martin, Jr. et al. | |
| 4,109,918 | A | | 8/1978 | Mele et al. | |
| 4,223,892 | A | * | 9/1980 | Matherne | 273/248 |
| 4,279,422 | A | | 7/1981 | Shaw | |
| 4,368,889 | A | | 1/1983 | Reker, Jr. | |
| 4,449,710 | A | * | 5/1984 | Davis | 273/249 |
| 4,566,698 | A | * | 1/1986 | Sneden | 273/249 |
| 4,591,161 | A | * | 5/1986 | Vanderhoof | 273/272 |
| 4,640,513 | A | * | 2/1987 | Montijo | 273/249 |
| 4,773,651 | A | * | 9/1988 | Papapavlou | 273/249 |
| 4,895,375 | A | * | 1/1990 | Blitz et al. | 273/258 |
| 4,984,805 | A | * | 1/1991 | Medlock | 273/248 |
| 4,998,735 | A | * | 3/1991 | Blackwell, III | 273/249 |
| 5,007,650 | A | | 4/1991 | Reed et al. | |
| 5,273,431 | A | | 12/1993 | Charouhas | |
| 5,660,389 | A | * | 8/1997 | Freda, III | 273/249 |
| 5,876,211 | A | | 3/1999 | Schmoyer et al. | |
| 5,906,371 | A | | 5/1999 | Peterson | |
| 6,019,370 | A | | 2/2000 | Morris | |
| 7,198,271 | B1 | | 4/2007 | Thomas | |
| 7,303,398 | B2 | * | 12/2007 | Soto | 434/128 |
| 7,549,639 | B2 | | 6/2009 | Martineau | |
| 7,699,317 | B2 | | 4/2010 | Eggers | |
| 7,896,347 | B1 | | 3/2011 | Vail | |
| 7,927,104 | B2 | | 4/2011 | Compton | |
| 8,025,295 | B2 | | 9/2011 | Bizilia | |
| 8,104,768 | B2 | | 1/2012 | Al-Buijan | |
| 2003/0218302 | A1 | | 11/2003 | Nelson | |

FOREIGN PATENT DOCUMENTS

| | | | | |
|---|---|---|---|---|
| FR | 2558383 | A1 | * | 7/1985 |

* cited by examiner

*Primary Examiner* — Vishu K. Mendiratta

(57) ABSTRACT

A board game is provided for a plurality of players comprising a game board including an innermost circle, a plurality of identical player domains, one for each player, a plurality of level regions, an aggregate of aggregated numbers of blank spaces defined in each of the player domains, and indicia for designating the level regions, and for identifying the player domains. The game further includes randomizing means including a plurality of dice having color coded surfaces, symbols, and/or graphic indicia imprinted thereon, question and answer cards indicating varying degrees of difficulty corresponding to the level regions, and a dice cup. Players roll the dice and ask and answer questions in turn to be first to earn an aggregate of first game pieces and place a second game piece on the innermost circle to end the game.

45 Claims, 9 Drawing Sheets

GRADUATION GAME

FIELD OF THE INVENTION

The present invention relates to an educational board game in which a plurality of players simulate the experience of graduating through a plurality of levels of an educational system, including an Elementary Level, a High School Level, a College Level, and a University Level, including a Bachelors Level, a Masters Level, and a Doctorate Level. The game includes a game board of circular configuration defining divisions of a plurality of annular segments representing the levels of the educational system upon which color coded credit tokens or first game pieces are placed to represent credits earned by the players as the game proceeds. The game also includes a plurality of game cards or question and answer cards having questions and answers imprinted thereon, and a plurality of dice having color codes, symbols, and/or graphic indicia imprinted on a number of dice surfaces for determining a possible number of actions a player may take during a turn. The game further includes a second game piece and a dice cup.

BACKGROUND OF THE INVENTION

Various types of board games that relate to educational objectives exist in which results are determined by chance devices such as dice or control cards which may include questions and answers which can be divided into various categories of subject matter encountered by a student or player with rules of play controlling the procedural steps followed in a game and determining the winner or winners in accordance with those rules.

Many previously developed games require players to recall specific information regarding various events and may involve various fields of endeavor such as sports, military actions, catastrophic events, political events, historical events and the like. Accordingly, such games that require specific information to play the games do not require the players to analyze situations, determine the results of various activities and make rational decisions in order to properly play the games to an advantageous result.

Typical of prior art game disclosure appears in published patent application U.S. 2003/0218302 that was published Nov. 27, 2003 and includes various game pieces, questions and answers relating to images of postage stamps.

In addition, U.S. Pat. No. 6,019,370 issued Feb. 1, 2000 discloses an educational board game which includes a game board having printed indicia thereon, rules of play, dice, question and answer cards and the like. This patent includes a listing of numerous prior patents relating to various types of board games utilizing various control devices for playing games in accordance with various rules of play.

While various prior art board games relate to educational experiences, they do not utilize a progression of educational experiences from a primary level through high school, college, university and the like, with the questions printed on the cards becoming increasingly difficult as the players progress through different levels of the educational system.

SUMMARY OF THE INVENTION

It is an object of the present invention to provide a game in which a plurality of players may compete in a simulated setting to be first to "graduate" through a number of designated levels of an educational system by acquiring knowledge and skills, and earning a number of credits tokens or game pieces at each of the levels to win the game.

Another object of the invention is to provide an educational game that is unique as players of varying intellectual ability can successfully compete against each other. While a player's familiarity with the information or knowledge on the question and answer cards could be an advantage in making progress in the game, anyone could play, enjoy and win the game depending only on good luck in rolling the dice and in drawing the cards. Thus the present invention provides a highly desirable educational and entertaining product in the form of a game that could be adapted for use by parents and teachers to enhance the acquisition of knowledge of their children or students through various educational levels in a pleasant and entertaining format.

A further object of the invention is to provide a game including a game board of circular configuration having a planar upper surface, and defining divisions of a plurality of identical, pie shaped peripheral player domains each extending radially from an innermost circle defined at a center of the game board to an outermost circle at an outermost periphery. The game board also includes a plurality of designated level regions, representing a number of levels of an educational system, extending in series from the innermost circle to the outermost periphery. Each of the player domains also includes an aggregate of aggregated numbers of blank spaces for placing a plurality of color coded first game pieces or credit tokens representing "credits" earned at a corresponding one of the designated level regions. The credit tokens may be in the form of color coded buttons or knobs. The terms "correspondence" and "corresponding" are impliedly used herein to mean "having an association to" or "being mentally connected to" as per dictionary meaning.

The game also includes randomizing means including a plurality of multi surfaced dice having a plurality of color codes, symbols, and/or other indicia imprinted on a number of dice surfaces to determine a possible number of credit tokens and corresponding game cards or question and answer cards a player may earn during a turn, in addition to a possible number of other actions the player may be required to take during the turn. The dice may be rolled from a dice cup which is also provided with the game.

The game also includes a plurality of game cards or question and answer cards color coded for correspondence to the credit tokens, the dice surfaces, and the designated level regions.

The game involves the use of knowledge, intelligence, varying degrees of analytical ability commensurate with the designated level regions, and the probability of luck and chance for arousing the excitement of players as they compete to be the first player to earn the required aggregate of credit tokens to win the game and cap the innermost circle or designated "Summa Cum Laude" circle with a second game piece or "Summa Cum Laude" token. (The term "to cap" is used herein to mean "to place on" with an implied sense of finality.)

These objectives, together with other objects and advantages which will become subsequently apparent, reside in the details of construction and operation as more fully hereinafter described and claimed, reference being had to the accompanying drawings forming a part hereof, wherein like numeral refers to like parts throughout.

DESCRIPTION OF THE PREFERRED EMBODIMENT

Figure 1:
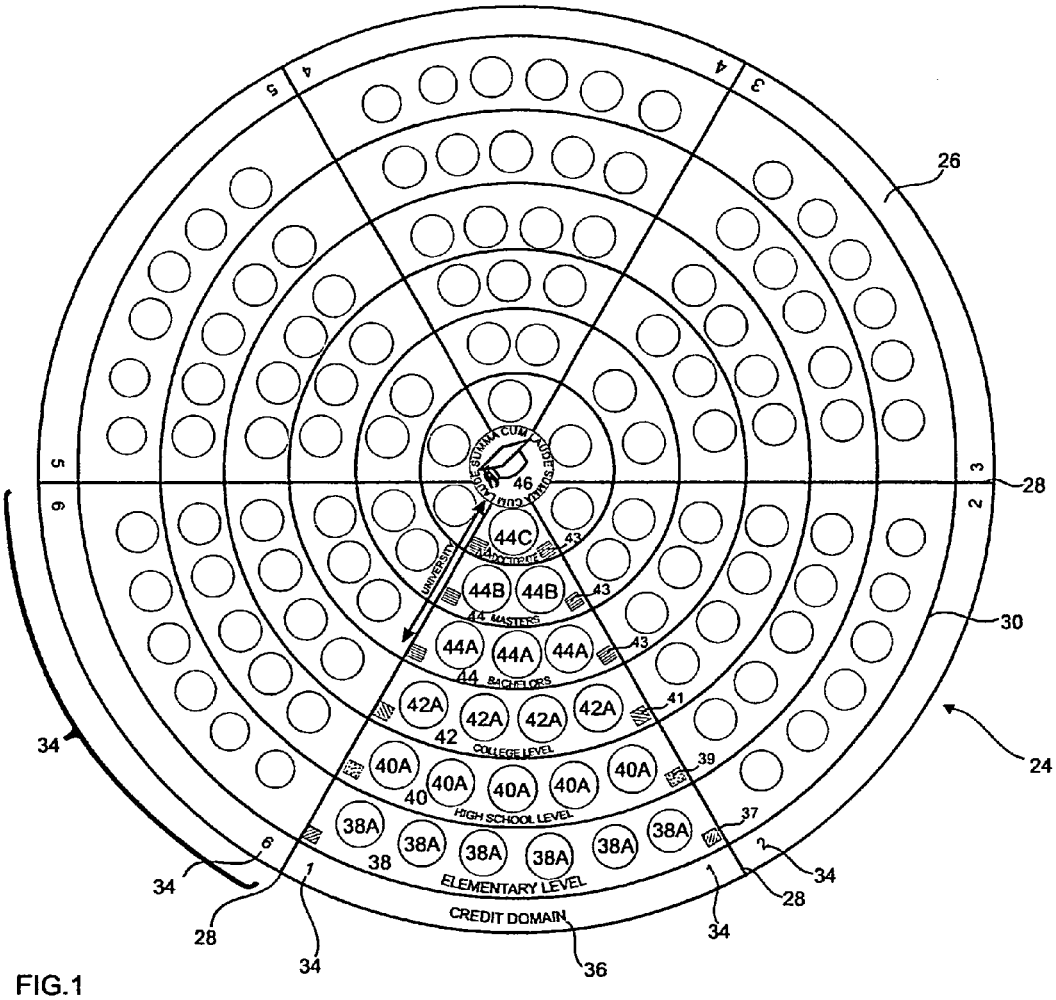
FIG. 1 is a plan view of a game board of circular configuration illustrating a preferred embodiment of the shape and configuration of the surface thereof. (Applicant has replaced the term "section" used in this paragraph by the term "surface" which a person of ordinary skill in the art would agree is more appropriate in this context.)

Although one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

The educational board game of the present invention illustrated in the accompanying drawings, FIGS. 1 thru 19, includes a game board of circular configuration 24 for up to six players, as shown in FIG. 1, having a planar upper surface 26 preferably constructed of substantially rigid cardboard, wood, metal or any other suitable material on which markings can be made. The game board 24 includes six evenly spaced concentric circles 30 extending outward from an innermost circle or "Summa Cum Laude" circle 46 defined at a center thereof to a circle at an outermost periphery. The six concentric circles define six adjacent annular level regions 38-44, with a level region adjacent the innermost circle including three level regions. The game board also includes generally descriptive terminology for designating each of the level regions, including an Elementary Level 38, a High School Level 40, a College Level 42, and a University Level 44, including a Bachelors Level, a Masters Level, and a Doctorate Level.

The game board also includes six division lines 28 each extending radially from the innermost circle to a circle at the outermost periphery, wherein the innermost circle, the radial division lines and the circle at the outermost periphery in combination define divisions of the game board into six identical pie shaped peripheral player domains 32 having a different one of numerical indicia (1, 2, 3, 4, 5, and 6) 34 printed on each of the player domains for identifying each of the player domains. Each of the player domains further includes an aggregate of aggregated numbers of circular blank spaces 38A-44C defined therein for placing a possible number credit tokens 114-120 earned by an assigned player during the game, with one of said blank spaces 44C being defined in the level region 44 adjacent the innermost circle 46, and the number of blank spaces in each adjacent level region 44, 42, and 40 increasing by one toward a sixth outermost level region 38 having six blank spaces 38A defined therein, with each of the aggregated numbers in the sequence of blank spaces being representative of the number of credit tokens a player requires for graduation at a corresponding one of said level regions, as illustrated in more detail in FIG. 2.

FIGS. 13, 14, 15, and 16 illustrate one hundred and twenty-six (126) color-coded credit tokens 114, 116, 118, and 120 for use in the preferred embodiment of the game. The number of credit tokens provided for use with the board of the preferred embodiment 24 is the same as the total number of blank spaces 38A-44C defined thereon. Each of the credit tokens 114-120 is color coded for correspondence to a different one of the designated level regions on the game board 24 and to other similarly coded elements of the game. Thirty-six (36) of the credit tokens 114 are color coded with a first color, red, for correspondence to the designated Elementary Level 38. Thirty (30) of the credit tokens 116 are color coded with a second color, orange, for correspondence to the designated High School Level 40. Twenty-four (24) of the credit tokens 118 are color coded with a third color, green, for correspondence to the designated College Level 42. Thirty-six (36) of the credit tokens 120 are color coded with a fourth color, blue, for correspondence to the designated University Level 44.

Figure 2:
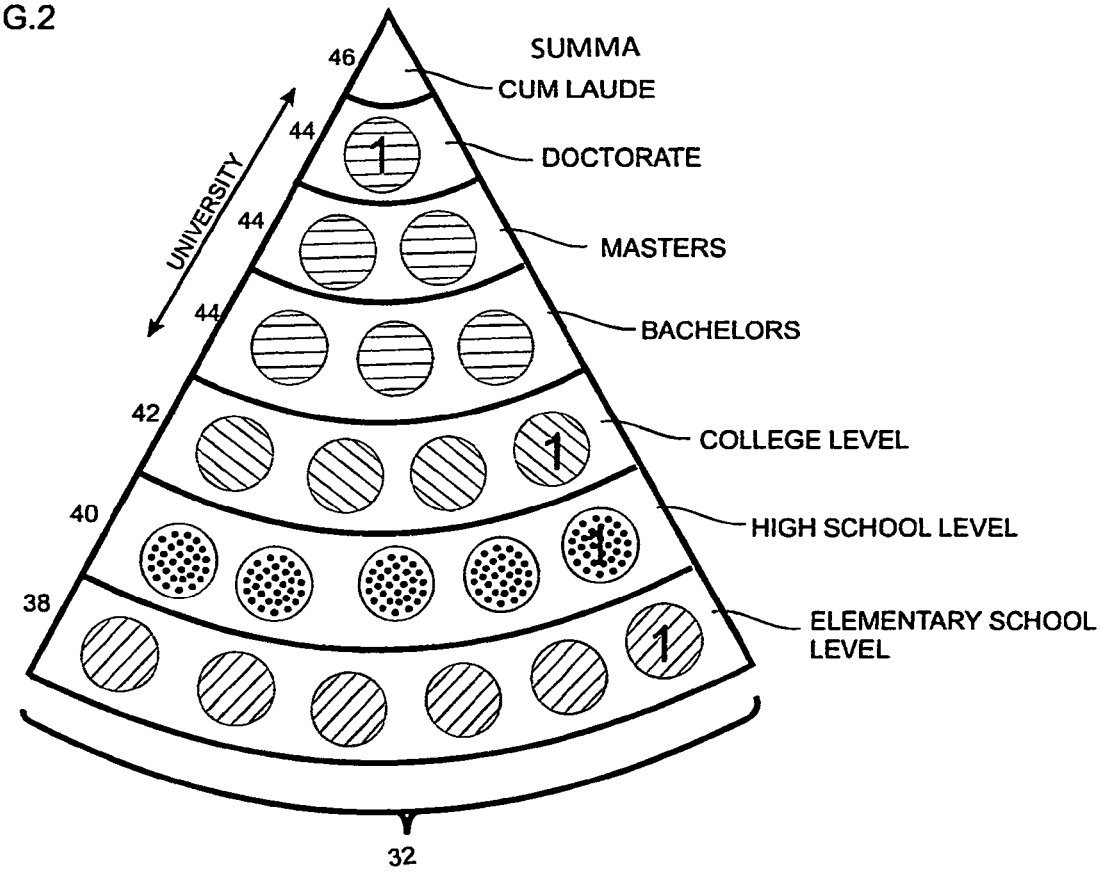
FIG. 2 is a sectionalized view of an area of the game board illustrating an exemplary detail of a plurality of credit tokens or first game pieces as they would be placed by an assigned player on an aggregate of blank spaces defined in the designated level regions in one of a number of player domains defined across the surface of the game board. (The terms "aggregate" and "aggregated" are used in this paragraph and throughout this amendment as being synonymous with the term "full" used on page 11, paragraph 1, 1.3 of the original (Sep. 18, 2006) disclosure.)
Figure 3:
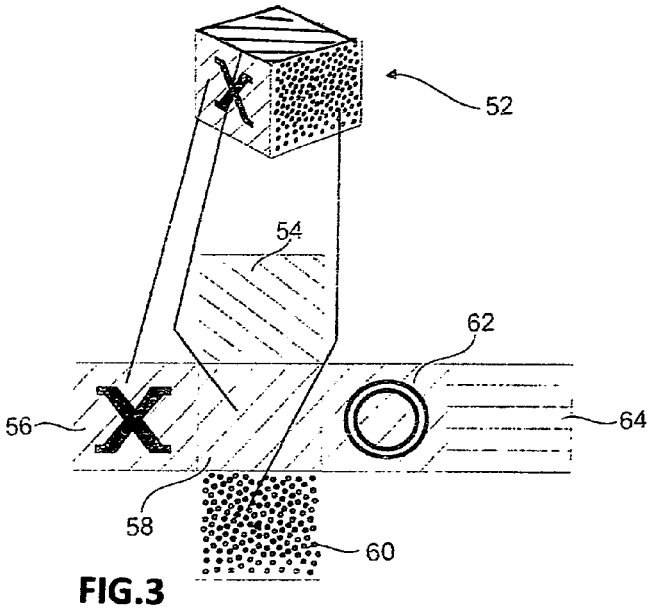
FIGS. 3, 4, 5, 6, 7, 8 and 19 are group plan views of a plurality of six surfaced dice including color codes, symbols, and graphic indicia imprinted on a number of dice surfaces for determining a possible number of credit tokens and corresponding question and answer cards or game cards a player may earn in a turn, and a possible number of additional actions the player may be required to take during the turn.
Figure 4:
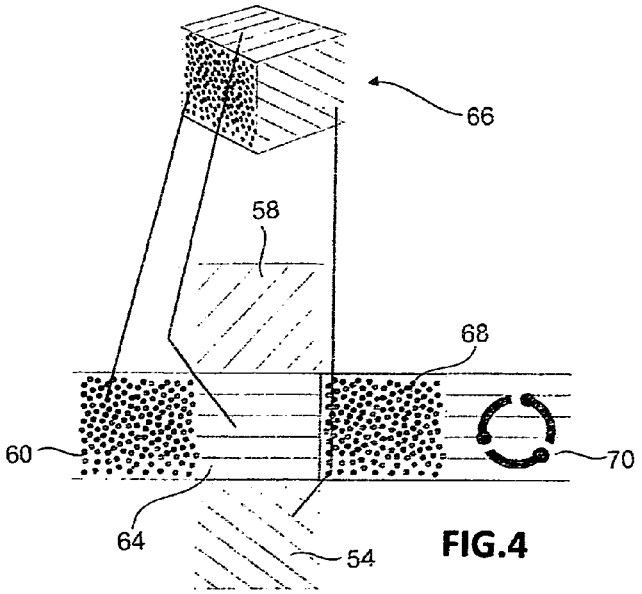
Figure 19:
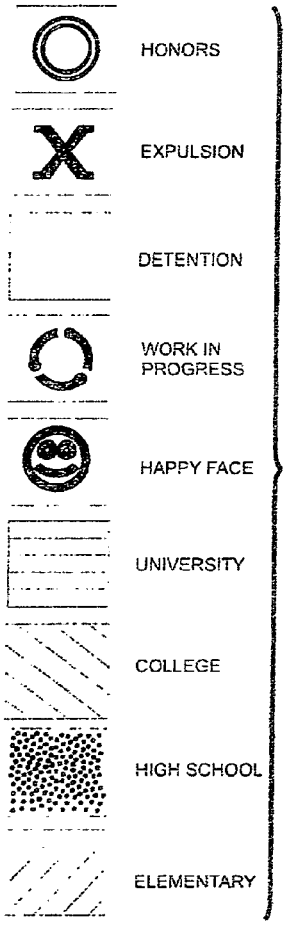
Figure 5:
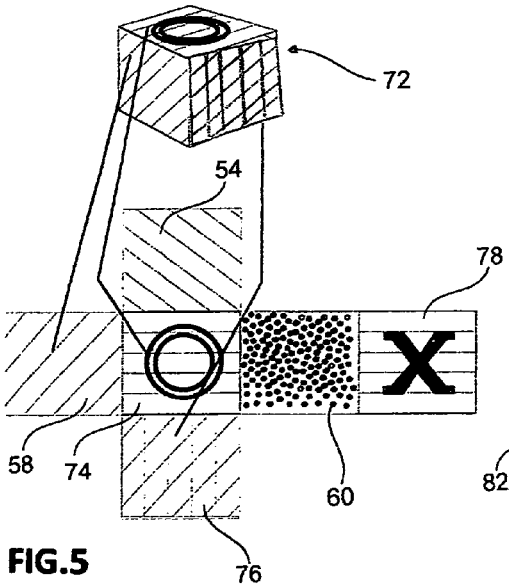
Figure 6:
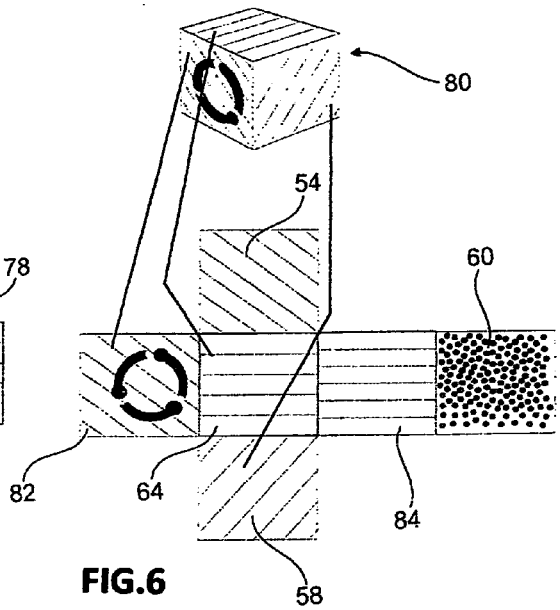
Figure 7:
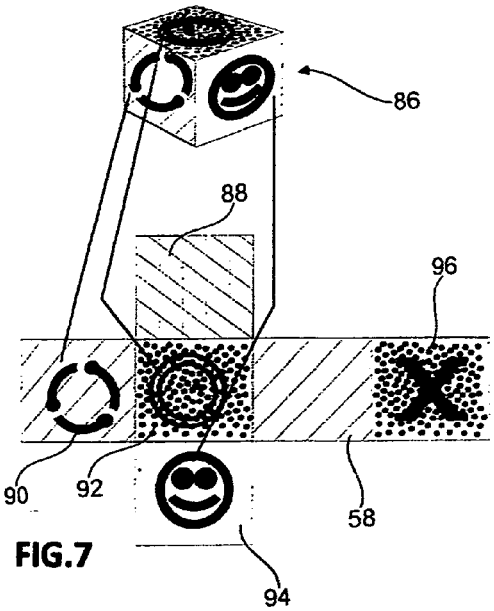
Figure 8:
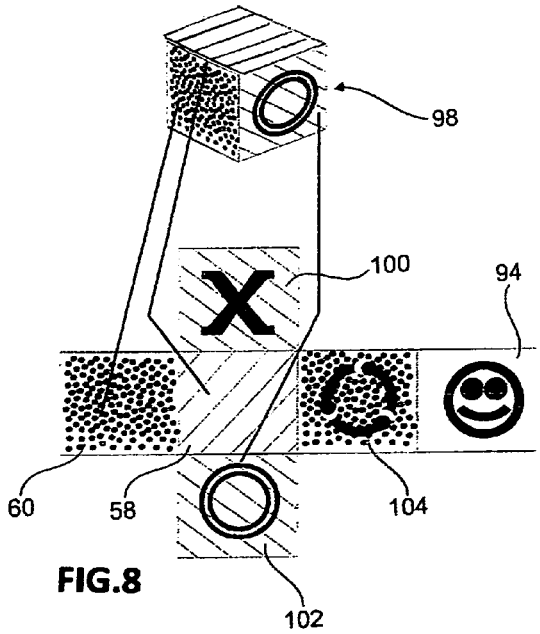

Six of the credit tokens 114A-114F, 116A-116F, 118A-118F, and 120A-120F corresponding to each of the level regions each has inscribed thereon one of the numerical indicia, 1, 2, 3, 4, 5, and 6, for further identifying the number of credit tokens earned by a player assigned to a corresponding one of the player domains. A player may place a credit token corresponding to each of a possible number of upward facing surfaces of the dice on the blank spaces in the designated level region within his player domain. A player who has earned the aggregated number of credit tokens to graduate at any of the level regions may place one of the credit tokens identified with his player section 114A-120F on one of the blank spaces in the corresponding level region. The first player to earn an aggregate of the aggregated numbers of credit tokens as shown in FIG. 2 wins the game and caps the "Summa Cum Laude" circle with the "Summa Cum Laude" token 46 to mark an end of the game.

FIGS. 3, 4, 5, 6, 7, 8, and 9 are group plan views of the dice 52, 66, 72, 80, 86, and 98 for use with the preferred embodiment. Each of the dice has a unique combination of color codes, symbols, and/or other kinds of indicia imprinted on the surfaces, with the significance of the symbols, the color codes, and indicia being illustrated centrally in FIG. 19.

Described in greater detail, one of the surfaces 58 of each of the dice is coded with same first color as the credit tokens 114 for use at the designated Elementary Level 38 to represent a number of possibilities of earning credit tokens at that level. One of the remaining surfaces 60 of each of five of the dice is coded with same second color as the credit tokens 116 for use at the designated High School Level 40 to represent a number of possibilities of earning credit tokens at that level. One of the remaining surfaces 54 of each of four of the dice is coded with same third color as the credit tokens 118 for use at the designated College Level 42 to represent a number of possibilities of earning credit tokens at that level, and one of the remaining surfaces 64 of each of three of the dice is coded with same fourth color as the credit tokens 120 for use at the designated University Level 44 to represent a number of possibilities of earning credit tokens at that level. Thus, eighteen (18) of the thirty-six (36) surfaces of the dice are each color coded with a different one of the four color codes to represent a number of possibilities of earning credit tokens at a possible number of the six level regions 24.

Figure 9A:
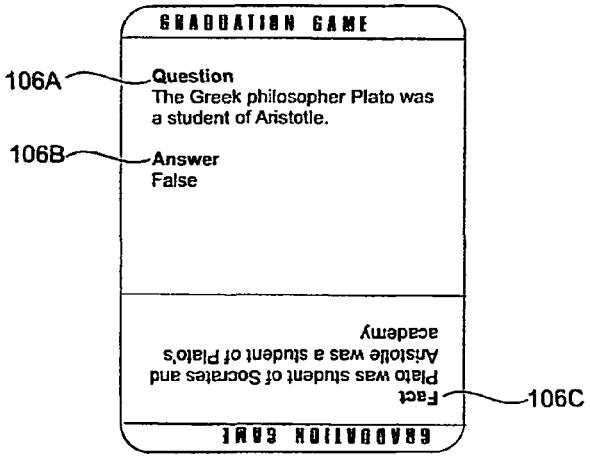
FIGS. 9A, 10A, 11A, and 12A are perspective views of typical bottom surfaces of the question and answer cards.
Figure 9:
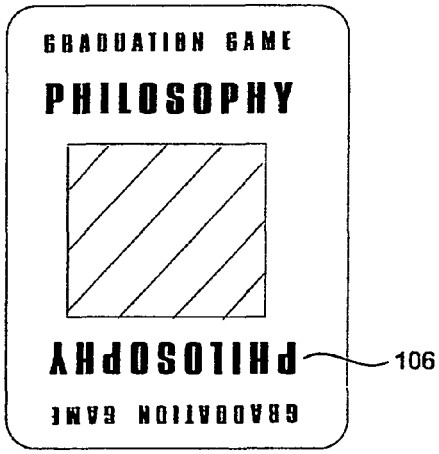
FIGS. 9, 10, 11, and 12 are perspective views of typical top surfaces of color coded question and answer cards.

Further, an additional four remaining surfaces of the dice are each color coded to correspond to the credit tokens for use at the designated Elementary Level 38, each of which has superimposed thereon a different one of four symbols shown in FIG. 9 representing a possible number of additional actions a player may be required to take during a turn. These include the possibility of earning an "Honors" reward 62, a "Work In Progress" reward 90, a "Detention" penalty 76, and an "Expulsion" penalty 56 at that level. Another four remaining surfaces of the dice are each color coded to correspond to the credit tokens for use at the designated High School Level 40, each of which has superimposed thereon a different one of the symbols representing the additional actions a player may be required to take during a turn. These include the possibility of earning an "Honors" reward 92, a "Work In Progress" reward 104, a "Detention" penalty 68, and an "Expulsion" penalty 96 at that level.

Another four surfaces of the dice are each color coded to correspond to the credit tokens for use at the designated College Level 42, each of which has superimposed thereon a different one of the four symbols representing a possible number of additional actions a player may be required to take during a turn. These include the possibility of earning an "Honors" reward 102, a "Work In Progress" reward 82, a "Detention" penalty 88, and an "Expulsion" penalty 100 at that level. A further four surfaces of the dice are each color coded to correspond to credit markers for use at the designated University level 44, each of which has superimposed thereon a different one of the four symbols shown in FIG. 9 representing a number of additional actions a player may be required to take during a turn. These include the possibility of earning an "Honors" reward 74, a "Work in Progress" reward 70, a "Detention" penalty 84, and an "Expulsion" penalty 78 at that level.

Thus, an additional sixteen (16) of the dice surfaces are color coded to correspond to the designated level regions, having superimposed thereon a different one of each of the four symbols representing a number of additional actions which a player may be required to take at each of the level regions during a turn. The remaining two (2) surfaces of the dice 94 may each have a number of other kinds of indicia, for example, a depiction of a "Happy Face" imprinted thereon to represent a number of other actions a player may take during a turn in accordance with a number of rules provided with the game.

FIGS. 9-12A are perspective views of a plurality of typical question and answer cards or cards 106, 108, 110, and 112 included for use with the preferred embodiment of the game. A bottom surface of each of said plurality of question and answer cards has imprinted thereon a different question, a corresponding answer to the question, and an elaboration on the answer relating to a body of information. A top surface of each of the cards has imprinted thereon a different one of the four color codes for correspondence to a different one of each of the sets of credit tokens. The top side of each of the cards may also include a legend of the general grouping of the subject dealt with in the plurality or pack of cards, for example, Philosophy. The color code and the information printed on each of the cards are duplicated on a second card in the pack for increasing the likelihood of luck and chance in the game. Also the information printed on each of the cards is formulated to reflect a varying degree of difficulty in relation to each of the designated level regions.

The game of the preferred embodiment includes one hundred and twenty-six (126) question and answer cards. The number of cards provided for use with the game is equal to the number of blank spaces 38A-44C included in all of the player domains as shown in FIG. 1, and also equal to the total number of credit tokens 38A-44C provided with the game, and illustrated in FIGS. 13, 14, 15, and 16. Thus, there are thirty-six (36) question and answer cards, illustrated in FIGS. 9 and 9A, having the same color code corresponding to the credit tokens for use at the designated Elementary Level 38. There are thirty (30) cards, illustrated in FIGS. 10 and 10A, having the same color code corresponding to the credit tokens for use at the designated High School Level 40. There are twenty-four (24) cards, illustrated in FIGS. 11 and 11A, having the same color code corresponding to the credit tokens for use at the designated College Level 42. There are also thirty-six (36) cards, illustrated in FIGS. 12 and 12A, having the same color code corresponding to the credit tokens for use at the designated University Level 44.

Figure 10A:
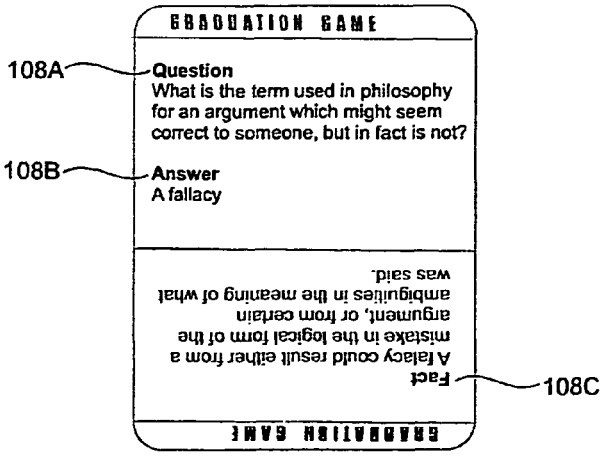
Figure 10:
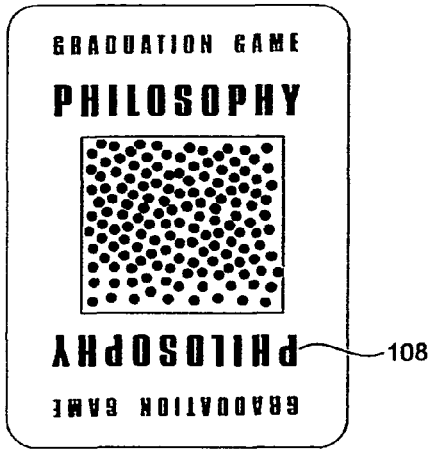

FIG. 9 illustrates a top surface of a typical question and answer card 106 having the color code corresponding to the credit tokens 114 for use at the designated Elementary Level 38, and a legend of the subject, Philosophy, dealt with in the game, imprinted thereon. FIG. 9A is an illustration of a bottom surface of the same card indicating the location of a question 106A, and a corresponding answer 106B printed at one end, and an elaboration on the answer 106C printed at the other end in an upside-down relationship. FIG. 10 illustrates a top surface of a typical question and answer card 108 having the color code corresponding to the credit tokens 116 for use at the designated High School Level 40, and a legend of the subject, Philosophy, dealt with in the game, imprinted thereon. FIG. 10A is an illustration of a bottom surface of the same card indicating the location of a question 108A, and a corresponding answer 108B printed at one end of the card, and an elaboration on the answer 108C printed at the other end in an upside-down relationship.

Figure 11A:
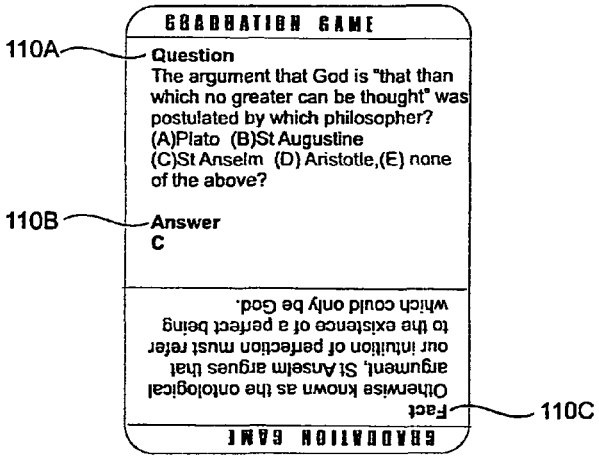
Figure 11:
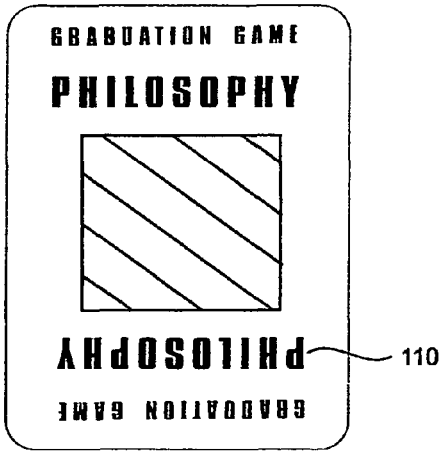
Figure 12A:
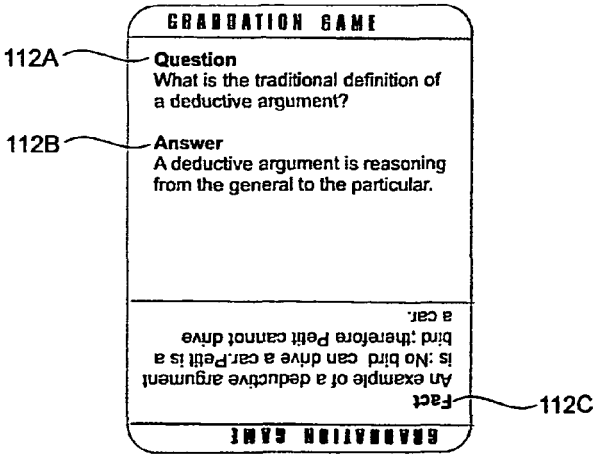
Figure 12:
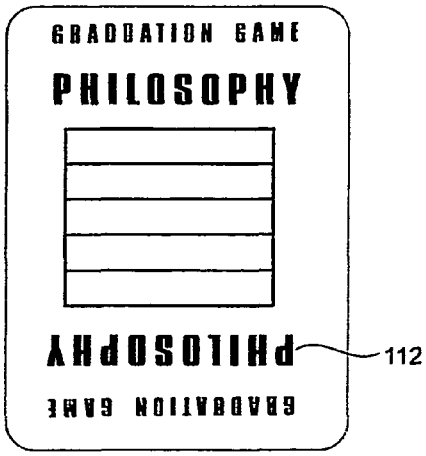
Figure 13:
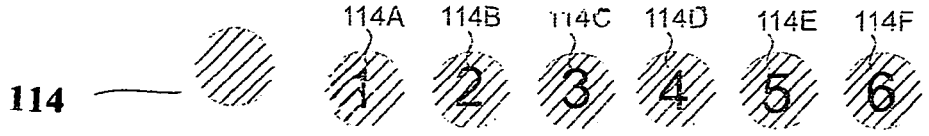
FIGS. 13, 14, 15, and 16 are perspective views of a plurality of credit tokens or game pieces sized for being placed on the blank spaces in a corresponding one of the designated level regions. (The term "blank" is used herein as per the dictionary meaning of being synonymous with "empty".)
Figure 14:
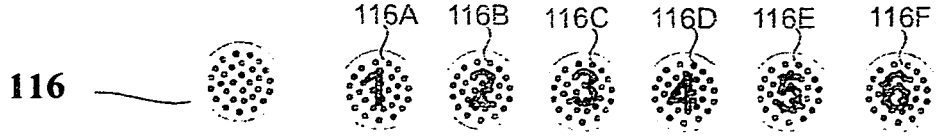
Figure 15:
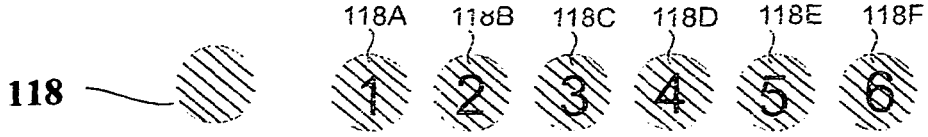
Figure 16:
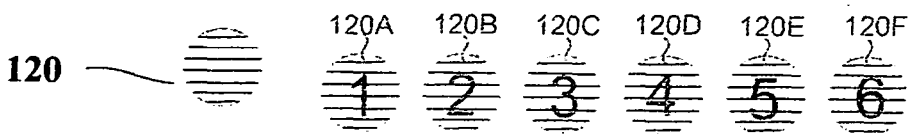

FIG. 11 illustrates a top surface of a typical card 110 having the color code corresponding to the credit tokens 118 for use at designated College Level 42, and a legend of the subject, Philosophy, dealt with in the game, imprinted thereon. FIG. 11A is an illustration of a bottom surface of the same card indicating the location of a question 110A, and a corresponding answer 110B printed at one end of the card, and an elaboration on the answer 110C printed at the other end in an upside-down relationship. FIG. 12 illustrates a top surface of a typical card 112 having the color code corresponding to the credit tokens for use at the designated University Level 44, and a legend of the subject, Philosophy, dealt with in the game, imprinted thereon. FIG. 12A is an illustration of a bottom surface of the same card indicating the location of a question 112A, and a corresponding answer 112B printed at one end of the card, and an elaboration on the answer 112C printed at the other end in an upside-down relationship. Thus the cards provide the information or knowledge on the particular subject dealt with in the game, indicate the levels of difficulty of the questions imprinted thereon, and provide players with an additional means to earn additional credit tokens and question and answer cards by questioning one another.

Figure 17:
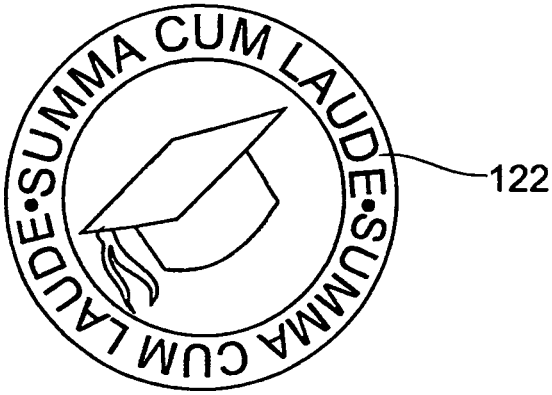
FIG. 17 is a perspective view of a second game piece or "Summa Cum Laude" token sized for capping an innermost circle or "Summa Cum Laude" circle by a winning player to mark an end of the game.

FIG. 17 is a perspective view of a second game piece or "Summa Cum Laude" token 122 sized for capping the innermost circle or "Summa Cum Laude circle" 46 by a winning player to mark the end of the game.

Figure 18:
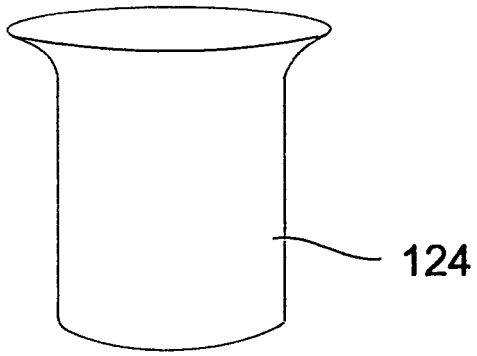
FIG. 18 is a perspective view of a dice cup sized for rolling the dice.

FIG. 18 is a perspective view of a dice cup sized and dimensioned for the players to roll the dice 52, 66, 72, 80, 86, and 98 in turn.

The object of the game is for one of the players to be first to place an aggregate of aggregated numbers of credit tokens 114-120 on the corresponding blank spaces 38A-44C in his player domain to become the winner, and cap the "Summa Cum Laude" circle 46 with the "Summa Cum Laude" token 122. The players having each been assigned to a different one of the player domains 34, a game begins with each player rolling the dice 52, 66, 72, 80, 86, and 90 from the cup 124 in turn, and taking all of the actions indicated by the upward facing surfaces of the dice, shown in FIGS. 3-8, including placing a credit token corresponding to a possible number of the color coded surfaces on a corresponding number of blank spaces in a possible number of designated level regions, and taking any additional actions indicated by the symbols on the dice surfaces, in addition to taking possession of a corresponding question and answer card from the pack of cards, typically illustrated in FIGS. 9-12, for each credit token 114-120, shown in FIGS. 13-16, earned thereby. The dice may be thrown by hand, shaken and discharged from the dice cup, or electronically generated.

A player in possession of any number of question and answer cards, typically illustrated in FIGS. 9-12A, may in subsequent turns select to use his cards to question other players as an alternative means of earning additional credit tokens and corresponding question and answer cards.

Only the questions on the game cards may be used during the game. The correct answer to a question is always the answer printed on the particular card. An answering player who incorrectly answers a question forfeits one of his credit tokens, shown in FIGS. 13-16, at the corresponding level, and a corresponding question and answer card, shown in FIGS. 9-12, to the questioning player. A player who correctly answers a question is entitled to take possession of a card and a corresponding credit token from the questioning player.

A player may begin to place credit tokens at any of the designated levels 38-44 at which he earns at least one credit token, shown in FIGS. 13-16. A player may qualify to "graduate" from a particular level region only after earning the required number of credit tokens to "graduate" from that level, having already "graduated" from all of the preceding levels. A player who has earned the aggregated number of credit tokens to "graduate" from a particular level region may place his identifying credit token 114A-120F corresponding to the particular level region on one of the blank spaces in that level region to indicate his preclusion from the consequences of the rules pertaining to that level region or any of the preceding levels. The first player to earn the aggregate of aggregated numbers of credit tokens as shown in FIG. 2 wins the game, and caps the innermost circle or "Summa Cum Laude" circle 42 with the "Summa Cum Laude" token 122 to mark the end of the game.

"The above rules and similar rules may be provided and offered with the player ultimately graduating from all levels being termed winner of the graduation game. It will be appreciated that the various rules of playing the game may be varied to enhance the interest in the game by maintaining competitive situations throughout each of the levels of the education system. The rules cannot be changed during the game and all players must comply with the established rules." In another embodiment of the invention, for example, a surface of the dice indicating "incomplete" does not earn a player any credit tokens, while the surface of the dice indicating "expulsion" deprives a player of a credit token already earned at the corresponding level. In the preferred embodiment, on the other hand, a surface of the dice indicating "Work-In-Progress" protects a player's credit tokens from the consequences of the "Detention" penalty at a corresponding level, while an "Expulsion" symbol deprives a player of a credit token already earned at the corresponding level.

It will be appreciated that the foregoing description and rules of play are merely illustrative of the principles and application of the invention. Many, if not all, of the different features of the game are flexible and could be adapted for use in a wide variety of situations. For instance, the game could be formatted to accommodate different educational levels and interests. Also, other packs of question and answer cards relating to other areas of information such as sports, science, arts, politics, geography, physics and the like could be formatted for use with the invention.

Further, since numerous modifications and changes will readily occur to those skilled in the art, it is not intended to limit the invention to the exact construction and operation shown and described herein. Accordingly, all suitable modifications and equivalents may be resorted to within the spirit and scope of the invention.

I claim:

1. An educational board game comprising:

(a) a game board having a planar upper surface including a defined center thereof, a plurality of identical pie-shaped peripheral player domains each extending radially from said defined center to an outermost periphery, one for each of a plurality of players, each of said plurality of player domains including an aggregate of aggregated numbers of blank spaces graduating in series from a smallest number of said aggregated numbers of blank spaces defined nearest said defined center to a largest number of said aggregated numbers of blank spaces defined nearest said outermost periphery, wherein said graduating series of blank spaces define a plurality of level regions extending from said defined center to said outermost periphery, first indicia designating each of said level regions as being distinguished from others of said level regions;

(b) a plurality of first game pieces including multiple sets of said first game pieces, each of said multiple sets of game pieces including a number of said game pieces having a same one of a plurality of color codes imprinted thereon but distinct from the color codes imprinted on said number of play pieces included in other sets of said game pieces for correspondence to one of said plurality of designated level regions, wherein said plurality of game pieces are sized for being placed on said blank spaces, and wherein each of said sets of game pieces is sufficient in number to provide each of said plurality of players with one of said game pieces for each of said blank spaces defined in said designated level regions in his player-domain;

(c) randomizing means including a plurality of dice, each of said plurality of dice having a plurality of dice surfaces, a first number of said plurality of dice surfaces each including a different one of said plurality of color codes corresponding to a different one of each of said sets of game pieces imprinted thereon for determining a possible number of game pieces a player may place on a possible number of said blank spaces in said designated level regions during a turn, a second number of said plurality of dice surfaces each including a different one of said plurality of color codes corresponding to said sets of game pieces imprinted thereon, and further including a different one of a number of symbols superimposed thereon for determining a possible number of additional actions said player may be required to take at a possible number of said designated level regions during said turn;

(d) a plurality of question and answer cards including multiple sets of said question and answer cards, each of said multiple sets of question and answer cards including a number of question and answer cards each having a different question, a corresponding answer to said question and an elaboration on said answer imprinted thereon, wherein each of said questions printed on said number of cards has a same degree of difficulty but distinguished from the degree of difficulty imprinted on said number of cards of other sets, each of said number of question and answer cards of each of said multiple sets of question and answer cards further including a same one of said color codes imprinted thereon but distinguished from said color codes imprinted on others of said sets of question and answer cards, wherein each of said color codes provides a correspondence to a different one of each of said sets of game pieces, wherein said difficulty of said question imprinted thereon is recognizable, and wherein each of said sets of question and answer cards is sufficient in number to provide each of said players with a corresponding question and answer card for each game piece earned by rolling said plurality of dice; and (e) a second game piece sized for capping said defined center by a first player to earn an aggregate of play pieces corresponding to said aggregate of aggregated numbers of blank spaces to mark an end of the game.

2. The game as defined in claim 1, in which said plurality of dice includes six six surfaced dice.

3. The game as defined in claim 2, wherein said first number of said plurality of dice surfaces comprises six of said dice surfaces color coded for correspondence to said set of game pieces corresponding to said elementary level, five of said dice surfaces color coded for correspondence to said set of game pieces corresponding to said high school level, four of said dice surfaces color coded for correspondence to said set of game pieces corresponding to said college level, and three of said dice surfaces color coded for correspondence to said game pieces corresponding to said university level, wherein only one surface of each of said plurality of dice may have a same one of said color codes imprinted thereon.

4. The game as defined in claim 3, wherein said second number of said plurality of dice surfaces includes an additional four of said dice surfaces color coded for correspondence to a same one of each of said multiple sets of game pieces each having a different one of four of said symbols.

5. The game as defined in claim 1, which further includes a dice cup sized and dimensioned for rolling said plurality of dice during the game.

6. The game as defined in claim 1, wherein said first indicia, beginning nearest said defined center, include UNIVERSITY LEVEL including DOCTORATE, MASTERS, and BACHELORS, COLLEGE LEVEL, HIGH SCHOOL LEVEL, and ELEMENTARY LEVEL.

7. The game as defined in claim 6, wherein said game board further includes a different one of numerical indicia 1, 2, 3, 4, 5, and 6 printed in the vicinity of each of said plurality of player domains for identifying each of said plurality of player domains as being distinguished from others of said player domains.

8. The game as defined in claim 1, wherein six of said game pieces of each of said multiple sets of game pieces each has a different one of said numerical indicia 1, 2, 3, 4, 5, and 6 imprinted thereon for further identifying said game pieces earned by said player assigned to a corresponding one of said player domains during the game.

9. The game as defined in claim 1, wherein each of said number of question and answer cards of each of said multiple sets of question and answer cards includes said different question, said corresponding answer, and said elaboration of the said answer imprinted on a bottom surface thereof.

10. The game as defined in claim 9, wherein each of said number of question and answer cards of each of said multiple sets of question and answer cards includes said same one of said color codes imprinted on a top surface thereof.

11. The game as defined in claim 10, wherein said top surface of each of said question and answer cards further includes a legend of said subject dealt with in said plurality of question and answer cards.

12. The game as defined in claim 11, wherein two question and answer cards of each of said number of question and answer cards include a same one of each of said different questions, said corresponding answers, said elaboration of the said answer, said color codes, and said legend imprinted thereon.

13. The game as defined in claim 1, wherein said game board is of circular configuration, and wherein said defined center is a circular space sized for receiving said second game piece.

14. The game as defined in claim 13, wherein each of said player domains includes one of said blank spaces in said level region adjacent said defined center and an additional blank space in each adjacent level region extending toward said outermost circle.

15. The game as defined in claim 1, wherein said plurality of color codes include one of red, orange, green, and blue for correspondence to a different one of each of said multiple sets of game pieces having a correspondence to said elementary level, said high school level, said college level, and said university level, respectively.

16. An educational board game comprising:

(a) a game board of circular configuration having a planar upper surface including six evenly spaced concentric circles extending in series from an innermost circle defined at a center of said game board to an outermost circle at an outermost periphery, wherein said concentric circles define six annular shaped level regions thereon, first indicia designating each of said six level regions as being distinguished from others of said level regions, six division lines each extending radially from said innermost circle to said outermost circle, wherein said division lines, said innermost circle, and said outermost circle in combination define divisions of said game board into six identical pie shaped peripheral player domains, one for each of six players, each of said player domains including an aggregate of aggregated numbers of blank spaces defined sequentially therein, wherein a level region adjacent said innermost circle includes one blank space, and each adjacent level region extending toward a sixth level region adjacent said outermost circle includes one more blank space than a preceding level region, one of numerical indicia 1, 2, 3, 4, 5, and 6 printed on a different one of each of said player domains for identifying each of said player domains as being distinguished from others of said player domains;

(b) one hundred and twenty six first game pieces comprising four sets of said first game pieces, each of said four sets of first game pieces including a number of said game pieces having a same one of four different color codes imprinted thereon for correspondence to a different one of said designated level regions, wherein each of said sets of game pieces has a different color code from the color codes imprinted on others of said sets, wherein said game pieces are sized for placement on said blank spaces, and wherein said game pieces are sufficient in number to provide each of said players with a number of said game pieces corresponding to said number of blank spaces in a corresponding one of said designated level regions within his player domain;

(c) randomizing means including six six surfaced dice, each of a first number of said plurality of dice surfaces including a different one of said color codes corresponding to said sets of game pieces imprinted thereon for determining a possible number of game pieces a player may earn at a possible number of said designated level regions during a turn, each of a second number of said dice surfaces including a different one of said color codes imprinted thereon, and further including a different one of a number of symbols superimposed thereon for determining a possible number of additional actions said player may be required to take at a possible number of said designated level regions during said turn; and (d) a second game piece sized for capping said innermost circle by a first player to earn a number of play pieces corresponding to said aggregate of aggregated numbers of blank spaces to mark an end of the game.

17. The game as defined in claim 16, wherein said first indicia, beginning at said innermost level region, include UNIVERSITY LEVEL including DOCTORATE, MASTERS, and BACHELORS, COLLEGE LEVEL, HIGH SCHOOL LEVEL, and ELEMENTARY LEVEL.

18. The game as defined in claim 16, wherein six of said game pieces of each of said four sets of game pieces each has imprinted thereon a different one one of said numeral indicia 1, 2, 3, 4, 5 and 6, for further identifying said game pieces earned by a different one of said players assigned to a corresponding one of said player domains during the game.

19. The game as defined in claim 16, which further includes a plurality of question and answer cards relating to a body of information on a particular subject.

20. The game as defined in claim 19, wherein said plurality of question and answer cards includes four sets of question and answer cards.

21. The game as defined in claim 20, wherein each of said sets of question and answer cards includes a number of said question and answer cards each including a different question reflecting a same degree of difficulty, but different from the degree of difficulty of the questions reflected on said number of cards of others of said sets of cards, a corresponding answer to said question, and an elaboration of said corresponding answer imprinted on a bottom surface thereof.

22. The game as defined in claim 21, wherein each of said number of question and answer cards of each of said sets of question and answer cards further includes a same one of said color codes corresponding to said sets of game pieces but distinguished from the color codes imprinted on others of said sets of game pieces, and a legend of said subject dealt with in said number of cards imprinted on a top surface thereof, wherein said degree of difficulty of said question is recognizable.

23. The game as defined in claim 22, wherein two question and answer cards of each of said multiple sets of question and answer cards include a same one of said different questions, said corresponding answer to said question, said elaboration of the said answer, said color code, and said legend imprinted thereon, wherein each of said sets of question and answer cards is sufficient in number to provide each of said players with a corresponding card for each game piece earned by rolling said plurality of dice, and wherein said cards provide an additional means for said players to earn additional game pieces and cards during the game.

24. The game as defined in claim 16, which further includes a dice cup sized and dimensioned for rolling said plurality of dice during the game.

25. The game as defined in claim 16 wherein said first number of said plurality of dice surfaces comprises six of said dice surfaces color coded for correspondence to said set of game pieces corresponding to said Elementary Level, five of said dice surfaces color coded for correspondence to said set of game pieces corresponding to said High School Level, four of said dice surfaces color coded for correspondence to said set of game pieces corresponding to said College Level, and three of said dice surfaces color coded for correspondence to said game pieces corresponding to said University Level, wherein only one surface of each of said plurality of dice may have a same one of said color codes imprinted thereon.

26. An educational game comprising:

(a) a game board having a planar upper surface, a plurality of lines defining a plurality of designated level regions extending outward from a defined center of said game board to an outermost periphery thereof, a plurality of radial division lines extending from said defined center to said outermost periphery, wherein said radial division lines, said defined center, and said outermost periphery in combination define divisions of said game board into a plurality of pie shaped peripheral player domains, one for each of a plurality of players, each of said pie shaped peripheral player domains including an aggregate of aggregated numbers of blank spaces defined therein, wherein a designated level region adjacent said center includes at least one of said aggregated number of blank spaces, and each adjacent level region extending toward said outermost periphery includes at least one additional blank space than a preceding level region, first indicia for indicating each of said designated level regions as being distinguished from others of said level regions, second indicia for identifying each of said player domains as being distinguished from others of said player domains;

(b) a plurality of first game pieces including multiple sets of said first game pieces, each of said multiple sets of game pieces having a different one of a plurality of color codes imprinted thereon to distinguish each of said multiple sets of game pieces from others of said multiple sets of game pieces, wherein said first game pieces are sized for placement on said blank spaces in a corresponding one of said designated level regions, and wherein each of said multiple sets of game pieces is sufficient in number to provide each of said players with a corresponding one of said game pieces for each of said blank spaces defined in each of said designated level regions;

(c) chance means including a plurality of dice, each of said plurality of dice including a plurality of dice surfaces, a first number of said plurality of dice surfaces each including a different one of said plurality of color codes corresponding to a color of one of said sets of game pieces imprinted thereon for determining a possible number of corresponding game pieces a player may place on a possible number of said blank spaces in a possible number of said designated level regions during a turn, a second number of said plurality of dice surfaces each including a different one of said plurality of color codes imprinted thereon, and further having a different one of a number of symbols superimposed thereon for determining a possible number of additional actions said player may be required to take at a possible number of said designated level regions during said turn;

(d) a plurality of question and answer cards including multiple sets of said question and answer cards, each of said multiple sets of question and answer cards including a number of question and answer cards each including a different question and a corresponding answer to said question with a same degree of difficulty imprinted thereon but distinguished from the degree of difficulty imprinted on said number of question and answer cards of other sets, each of said question and answer cards further including an elaboration of said corresponding answer imprinted thereon, each of said multiple sets of question and answer cards further including a different one of said plurality of color codes imprinted thereon, wherein each of said sets of question and answer cards is sufficient in number to provide each of said players with a corresponding card for each game piece earned by rolling said plurality of dice;

(e) a dice cup sized and dimensioned for rolling said plurality of dice during the game; and (f) a second game piece sized for capping said defined center to mark an end of the game.

27. The game as defined in claim 25, wherein said second number of said dice surfaces includes an additional four of said dice surfaces color-coded for correspondence to a same one of each of said multiple sets of game pieces each having a different one of four of said symbols.

28. The game as defined in claim 27, in which two remaining dice surfaces each has graphic indicia imprinted thereon to indicate a number of other actions a player may take during a turn in accordance with a number of game rules which are provided with the game.

29. The game as defined in claim 26, wherein said game board is of circular configuration, and wherein said defined center is a circular space sized to receive said second game piece.

30. The game as defined in claim 29, wherein said first indicia, beginning at said innermost level, include UNIVERSITY LEVEL, including DOCTORATE LEVEL, MASTERS LEVEL, and BACHELORS LEVEL, COLLEGE LEVEL, HIGH SCHOOL LEVEL, and ELEMENTARY LEVEL.

31. The game as defined in claim 26, wherein said Doctorate Level includes one blank space defined in each of said player domains thereof, said Masters Level includes two blank spaces defined in each of said player domains thereof, said Bachelors Level includes three blank spaces defined in each of said player domains thereof, said College Level includes four of said blank spaces defined in each of said player domains thereof, said High School Level includes five of said blank spaces defined in each of said player domains thereof, and said Elementary Level includes six blank spaces defined in each of said player domains thereof.

32. The game as defined in claim 26, wherein said second indicia include one of numerals 1, 2, 3, 4, 5, and 6 printed in the vicinity of a different one of each of said plurality of player domains.

33. The game as defined in claim 26, wherein said plurality of color codes include one of red, orange, green, and blue for correspondence to a different one of each of said multiple sets of game pieces having a correspondence to said Elementary Level, said High School Level, said College Level, and said University Level, respectively.

34. The game as defined in claim 26, wherein at least six of each of said multiple sets of said game pieces each includes one of numerals 1, 2, 3, 4, 5, and 6 imprinted thereon to further identify a possible number of said game pieces earned by each of said players assigned to a corresponding one of each of said player domains during the game.

35. The game as defined in claim 34, wherein six of each of said multiple sets of game pieces each includes one of numerals 1, 2, 3, 4, 5, and 6 imprinted thereon to further identify a possible number of said game pieces earned by each of said players assigned to a corresponding one of each of said player domains during the game.

36. The game as defined in claim 26, wherein said plurality of dice include six six surfaced dice.

37. The game as defined in claim 36, wherein said first number of said plurality of dice surfaces comprises six of said dice surfaces color coded for correspondence to said set of game pieces corresponding to said Elementary Level, five of said dice surfaces color coded for correspondence to said set of game pieces corresponding to said High School Level, four of said dice surfaces color coded for correspondence to said set of game pieces corresponding to said College Level, and three of said dice surfaces color coded for correspondence to said game pieces corresponding to said University Level, wherein only one surface of each of said plurality of dice may have a same one of said color codes imprinted thereon.

38. The game as defined in claim 37, wherein said second number of dice surfaces includes an additional four of said plurality of dice surfaces color coded to correspond to a different one of each of said multiple sets of game pieces each having a different one of four of said symbols.

39. The game as defined in claim 38, in which a remaining two of said dice surfaces may include graphic indicia to determine a number of other actions a player may be required to take during a turn in accordance with a number of rules provided with the game.

40. The game as defined in claim 39, wherein a method for simulating said number of players graduating through said plurality of levels of an educational system comprises:

providing said plurality of players with said game, instructing said plurality of players on said number of rules provided with said game, assigning each of said plurality of players to a different one of said six player domains, each of said plurality of players rolling said plurality of dice from said cup in turn in accordance with said rules of said game, said each of said plurality of players placing one of said plurality of game pieces corresponding to each of a possible number of upward facing color coded surfaces of said plurality of dice on said designated blank spaces in a possible number of level regions within his player domain, said each of said plurality of players taking possession of one of said question and answer cards corresponding to each of said game pieces earned thereby, each of said plurality of players further taking a possible number of additional actions indicated by said symbols and graphic indicia showing up on a possible number of said plurality of dice surfaces in accordance with said game rules, each of said plurality of players subsequently selecting to alternate between rolling said plurality of dice, or using said question and answer cards in his possession to question other players to earn additional game pieces and question and answer cards, the game continuing in accordance with said number of rules, a first player earning said number of game pieces corresponding to said aggregate of said aggregated numbers of blank spaces thereby winning the game, and capping said innermost circle with said second game piece to mark an end of the game.

41. The game as defined in claim 26, wherein each of said number of question and answer cards of each of said multiple sets of question and answer cards has said different question, said corresponding answer, and said elaboration of said answer imprinted on a bottom surface thereof.

42. The game as defined in claim 41, wherein each of said number of question and answer cards of each of said multiple sets of question and answer cards further includes said different one of said plurality of color codes imprinted on a top surface wherein said difficulty of said question is recognizable.

43. The game as defined in claim 42, wherein said top surface of each of said question and answer cards of each of said multiple sets of question and answer cards may further include a legend of the subject dealt with in said plurality of game cards.

44. The game as defined in claim 43, wherein said plurality of question and answer cards is sufficient in number to provide for a player to possess a game card corresponding to each game piece earned by rolling said plurality of dice.

45. The game as defined in claim 44, wherein two question and answer cards of each of said multiple sets of game cards has a same one of said different questions, said corresponding answers, said elaboration of the said answer, said color code, and said legend imprinted thereon.

* * * * *